United States Patent [19]

Whelan

[11] 4,094,443

[45] June 13, 1978

[54] PAINT STRAINER DISPENSER

[75] Inventor: James P. Whelan, N. Marshfield, Mass.

[73] Assignee: Ad-Tec Products, Inc., Plymouth, Mass.

[21] Appl. No.: 699,663

[22] Filed: Jun. 25, 1976

[51] Int. Cl.[2] ..... B65H 1/00
[52] U.S. Cl. ..... 221/63
[58] Field of Search ..... 211/309, 307, 303, 33, 211/63

[56] References Cited

U.S. PATENT DOCUMENTS

| | | | |
|---|---|---|---|
| 2,941,693 | 6/1960 | Matteson | 221/309 X |
| 3,604,592 | 9/1971 | Bacon | 221/303 |

*Primary Examiner*—Allen N. Knowles
*Attorney, Agent, or Firm*—Dike, Bronstein, Roberts, Cushman & Pfund

[57] ABSTRACT

A dispenser for conical paint strainers comprising a vertically elongate hollow structure having an open lower end and front and back supports at the open lower end for removably supporting a stack of cones in the structure with their apices uppermost for removal of cones one or more at a time while leaving the remaining cones supported therein.

5 Claims, 8 Drawing Figures

PAINT STRAINER DISPENSER

BACKGROUND OF INVENTION

Dispensing receptacles of one kind or another from a stack supported in a dispensing apparatus are old in the art as shown, for example, in Tobey U.S. Pat. No. 2,570,167, Morin U.S. Pat. No. 1,698,239, and Sutton U.S. Pat. No. 3,019,940. However, none of the devices shown in the aforesaid patents are suitable for dispensing cone-shaped structures such as cone-shaped paint filters, nor do they provide for the ease of loading, removal of receptacles one at a time or a number at a time, nor do they provide for the simplicity of structural makeup and economy in manufacture afforded by the structure of this invention.

SUMMARY OF INVENTION

As herein illustrated, the dispenser comprises a hollow tubular structure having an open lower end for receiving a stack of cone-shaped containers with their apices uppermost and means at the front and rear sides of the structure internally thereof upon which the open top of the lowermost container in a stack is adapted to rest, said means providing a three-point support, one at the back and two at the front, such that by grasping the lowermost container at the front and displacing it toward the back to disengage it from the two front supports, the lowermost container may be tipped downwardly about the rear support and removed while leaving the containers thereabove supported. The structure has at the front between the front supports an opening providing access to the interior thereof through which the lowermost container may be grasped to displace it rearwardly and tip it downwardly. The containers which are cone-shaped have diametrically disposed supporting ears and the rear support is spaced forwardly from the rear side of the structure and the front supports are spaced apart such that the diametrically disposed supporting ears at the open top of the containers can be respectively lodged in the space behind the rear support and in the space between the front supports. The rear support is in the form of an elongated pin supported at its ends in the wall of the structure forwardly of the rearmost side providing a space between it and the rearmost side and the front supports are horizontally disposed tabs extending radially inwardly from the front side.

Referring to the drawings, FIG. 1 is a front elevation of the dispenser;

The dispenser herein illustrated is for the purpose of dispensing cone-shaped paint filters stacked in a column in such a way that a single cone or several cones may be removed as desired without danger of the remaining cones cascading from the dispenser. The dispenser is further designed to enable easily loading it with a stack of cones.

Figure 1:
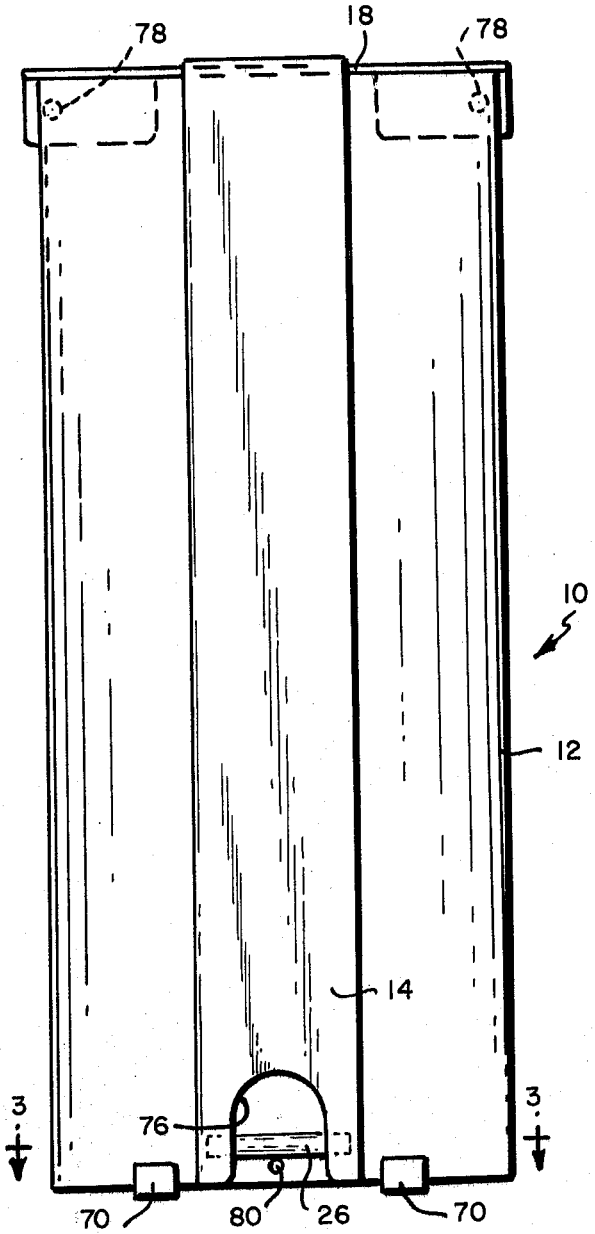
Figure 2:
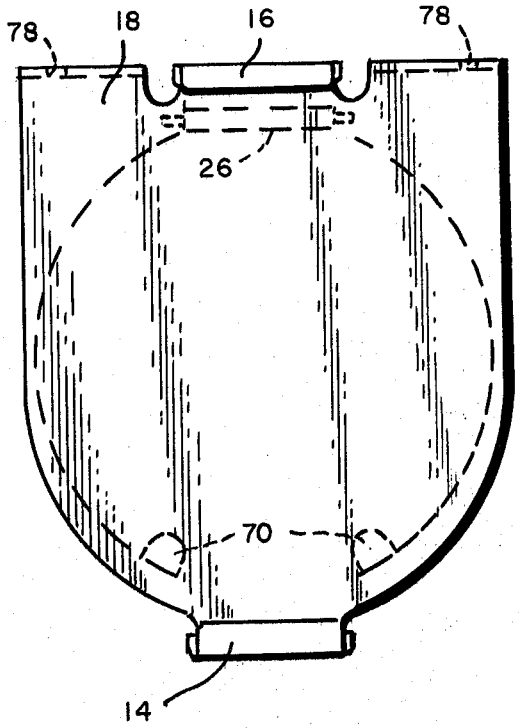
FIG. 2 is a top view.
Figure 3:
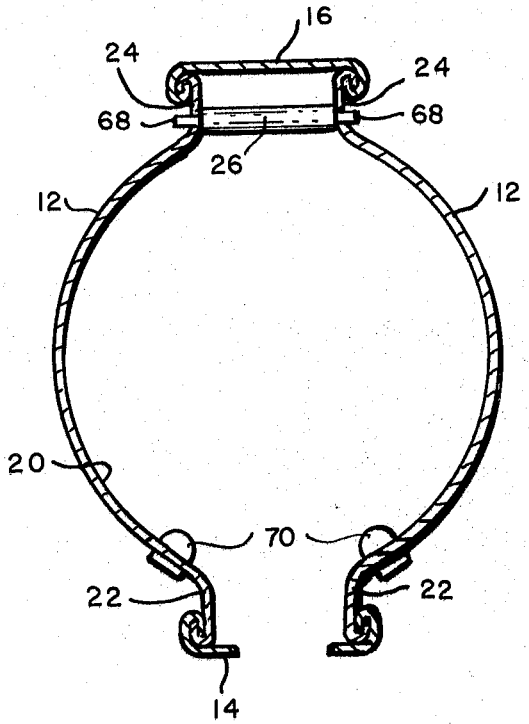
FIG. 3 is a horizontal section taken on the line 3—3 of FIG. 1.
Figure 4:
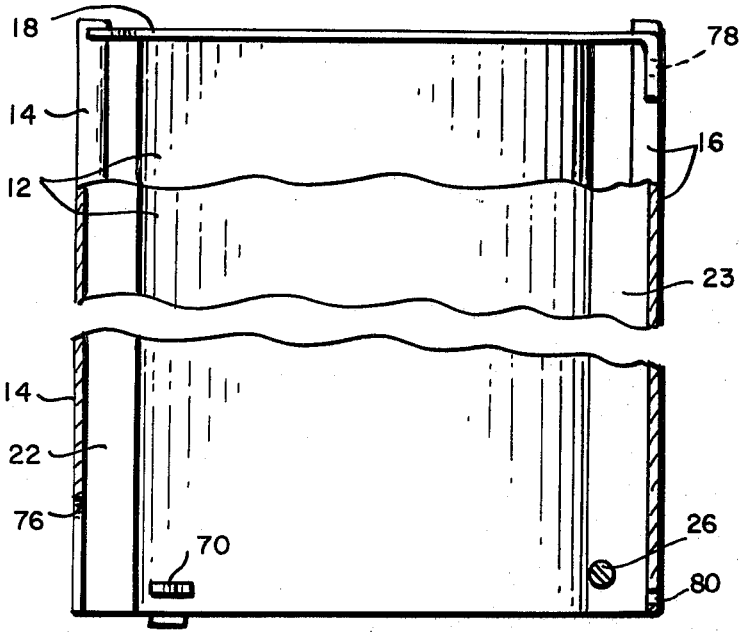
FIG. 4 is a side view as seen from the right side of FIG. 2 broken away and partly in elevation and partly in section.

As illustrated in FIG. 1, the dispenser 10 comprises a vertically elongate hollow structure of generally cylindrical configuration as shown in FIG. 3 having cylindrically arcuate side walls 12—12 joined at the front and back by flat, substantially rectangular panel members 14 and 16, respectively. The bottom or lower end of the structure is open and the top is covered by a closure plate 18.

The structure provides an internal cylindrical chamber 20 which corresponds substantially in diameter to the open top of the cones of the stack of cones that are to be dispensed. The two side walls 12—12 have at their forward and rear edges, margin flanges 22—22 and 24—24 which are substantially parallel to each other projecting forwardly and rearwardly of the chamber 20. The panels 14 and 16 are respectively clinched to the flanges 22—22 and 24—24 as illustrated in FIG. 3.

Figure 5:
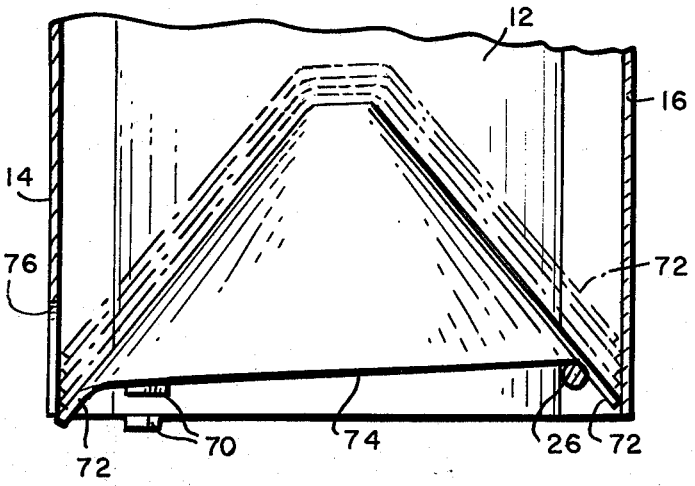
FIG. 5 is a view similar to the lower part of FIG. 4 showing a stack of cones supported in the dispenser.
Figure 6:
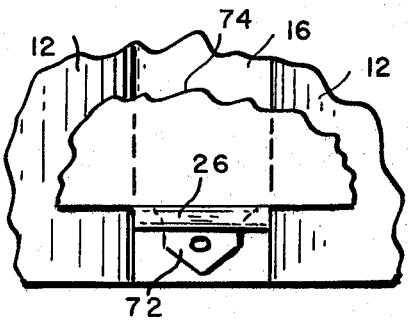
FIG. 6 is a fragmentary elevation at the rear side showing an ear of the lowermost cone resting on the back support.

At the lower end of the structure, there is a horizontal bar 26 of circular cross section provided at its ends with pins 68—68 which extend through holes in the flanges 24—24. At the forward side of the structure, at opposite sides of the space between the flanges 22—22, there are horizontal inwardly extending tabs 70—70. The bar 26 and the tabs 70—70 provide front and rear supports for a stack of cones as shown in FIG. 5. The cones have at their open mouth diametrically disposed ears 72—72 and when the cones are disposed in the structure, they are oriented so that one of the ears 72 projects downwardly into the space between the bar 26 at the rear and the panel 16 and the other ear is disposed between the tabs 70—70 at the front so that it projects into the space between the side walls 22—22 and the rim 74 rests on these tabs.

The panel 14 at the front side of the structure at its lower end contains an upwardly concave opening 76 which provides access to the interior of the structure.

Figure 7:
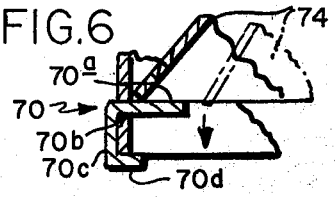
FIG. 7 is a fragmentary section through one of the front supports showing a cone resting thereon and in dotted lines a cone displaced rearwardly therefrom.
Figure 8:
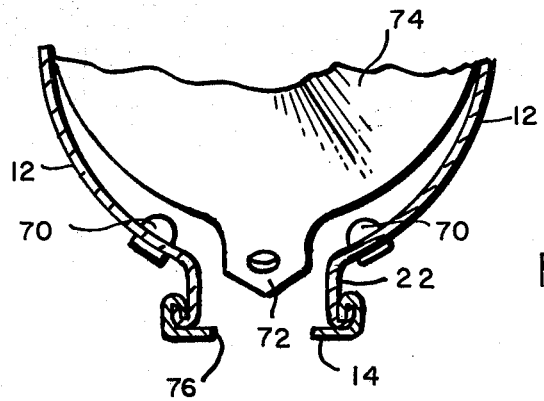
FIG. 8 is a fragmentary horizontal section showing displacement of the forward ear of the cone from the front supports.

As thus arranged, the lowermost cone may be removed without any of the cones above it being released by grasping the ear 72 at the front and pushing it rearwardly as shown in FIGS. 7 and 8 to disengage the rim 74 at each side from the spaced tabs 70—70, whereupon the cone may be pulled downwardly about the axis of the bar 26 as a pivot and removed from the lower open end of the structure. The cones above the one pulled downwardly will remain seated on the front and back supports. It is possible, of course, to remove two or three cones at a time if this is desired, but, in any event, no more cones will be released than those which are grasped and displaced from the front support.

The structure as thus designed is very easy to load since all that is necessary is to push the stack of cones upwardly from the open lower end into the structure and allow the lowermost cone to rest upon the front and back supports. The supports not only maintain the cones within the structure, but hold the cones aligned within the stack.

The structure is designed for easy manufacture in that the side walls 12—12 and the front and rear panels 14 and 16 are identical pairs and can be slidably engaged with each other and then crimped to secure them to each other without needs for welding, molding, soldering, or the like. The structure may be comprised of aluminum sheet metal or plastic as desired.

Holes 76 at the top and 78 at the bottom are provided for fastening the structure to a wall.

It should be understood that the present disclosure is for the purpose of illustration only and includes all modifications or improvements which fall within the scope of the appended claims.

I claim:

1. A dispenser for the dispensing of containers from an inverted stack of containers, said containers having diametrically disposed, radially extending ears, comprising a vertically elongate tubular structure open at its bottom, said tubular structure having diametrically disposed openings at the back and front sides extending from top to bottom of a width to receive the diametrically disposed ears of a stack of containers situated in the structure, a support bar adjacent the lower end of the structure extending across the opening at the back side, two supports at the front side, one at each side of the opening at the front side, said supports at the back and front side being so situated that when the inverted stack is disposed in the structure, the ears at the back side of the stack extend through the opening at the back side over the support bar, the ears at the front side extend through the opening at the front side and the rim of the lowermost container of the stack rests on the supports at the opposite sides of the opening at the front side, said opening at the front side providing access to the stack to enable grasping the ear at the front side of the lowermost container and thrust the rim at the front side off the supports to thus permit the lowermost container to be pulled downwardly.

2. A dispenser according to claim 1 wherein the cylindrical structure comprises a pair of arcuate side walls sections along the opposite longitudinal edges of which there are rearwardly and forwardly extending spaced parallel flanges defining the openings at the back and front and flat panels corresponding in width and length to the openings connected to and connecting the free edges of the flanges and wherein the panel at the front side has at its lower end an access opening through which may be grasped the ears of the containers at the lower end of the stack.

3. A dispenser according to claim 2 wherein there are means at the edges of the flanges and the panels slidingly interengageable to enable assembling the side walls sections and panels.

4. A dispenser according to claim 3 wherein said means are adapted to be crimped to fix the side walls sections and panels in assembled relation.

5. A dispenser according to claim 2 wherein the support bar is situated within the opening at the back side with its ends mounted in the flanges.

* * * * *